US007847768B2

(12) United States Patent
Kim

(10) Patent No.: US 7,847,768 B2
(45) Date of Patent: Dec. 7, 2010

(54) ORGANIC ELECTROLUMINESCENCE DISPLAY AND DRIVING METHOD THEREOF

(75) Inventor: Hong Kwon Kim, Euiwang-si (KR)

(73) Assignee: Samsung Mobile Display Co., Ltd., Yongin-si (KR)

( * ) Notice: Subject to any disclaimer, the term of this patent is extended or adjusted under 35 U.S.C. 154(b) by 727 days.

(21) Appl. No.: 11/650,957

(22) Filed: Jan. 9, 2007

(65) Prior Publication Data

US 2007/0279343 A1 Dec. 6, 2007

(30) Foreign Application Priority Data

Jun. 5, 2006 (KR) ..... 10-2006-0050485

(51) Int. Cl.
*G09G 3/32* (2006.01)

(52) U.S. Cl. ..... 345/82; 345/76; 345/77; 345/206; 345/690; 345/691

(58) Field of Classification Search ..... 345/82, 345/206, 691, 690, 76, 77
See application file for complete search history.

(56) References Cited

U.S. PATENT DOCUMENTS

| | | | | |
|---|---|---|---|---|
| 6,008,588 | A | 12/1999 | Fujii | |
| 7,224,334 | B2 | 5/2007 | Choi et al. | |
| 7,286,106 | B2 | 10/2007 | Komiya et al. | |
| 7,403,176 | B2 | 7/2008 | Chung et al. | |
| 2004/0056828 | A1 | 3/2004 | Choi et al. | |
| 2004/0145597 | A1 | 7/2004 | Ito | |
| 2004/0217925 | A1 | 11/2004 | Chung et al. | |
| 2005/0046619 | A1 * | 3/2005 | Senda et al. | 345/76 |
| 2005/0083271 | A1 * | 4/2005 | Suh et al. | 345/76 |
| 2005/0104815 | A1 | 5/2005 | Komiya et al. | |
| 2005/0104875 | A1 * | 5/2005 | Kwak et al. | 345/204 |
| 2005/0259053 | A1 | 11/2005 | Iwabuchi | |
| 2006/0061529 | A1 | 3/2006 | Kim | |

(Continued)

FOREIGN PATENT DOCUMENTS

| | | |
|---|---|---|
| CN | 1622168 | 6/2005 |

(Continued)

OTHER PUBLICATIONS

Notice of Allowance issued in corresponding Korean Patent Application No. 2006-0050485 dated Nov. 30, 2007.

(Continued)

*Primary Examiner*—Richard Hjerpe
*Assistant Examiner*—Saifeldin Elnafia
(74) *Attorney, Agent, or Firm*—Stein McEwen, LLP

(57) ABSTRACT

Disclosed are an organic electroluminescence display having simple configurations of a pixel circuit and a driving circuit by using a frequency characteristic of an organic electroluminescence device to display a gray level, and a driving method thereof. The present invention provides an organic electroluminescence display including a plurality of scan lines for transmitting a scan signal; a plurality of data lines for transmitting a digital data signal; a plurality of emission control lines for transmitting an emission control signal; and a plurality of pixels defined by a plurality of power supply lines for supplying a power supply, wherein the scan signal is transmitted to a plurality of subframes, and the emission control signal have different frequencies in a plurality of the subframes, and a driving method thereof.

13 Claims, 6 Drawing Sheets

U.S. PATENT DOCUMENTS

| | | | |
|---|---|---|---|
| 2006/0077138 | A1 | 4/2006 | Kim |
| 2006/0092107 | A1 | 5/2006 | Kim |
| 2006/0092148 | A1 | 5/2006 | Ozawa et al. |

FOREIGN PATENT DOCUMENTS

| | | |
|---|---|---|
| CN | 1750100 | 3/2006 |
| JP | 9-114414 | 5/1997 |
| JP | 10-12381 | 1/1998 |
| JP | 10-232649 | 9/1998 |
| JP | 10-319909 | 12/1998 |
| JP | 2000-347622 | 12/2000 |
| JP | 2001-60076 | 3/2001 |
| JP | 2002-215096 | 7/2002 |
| JP | 2003-099000 | 4/2003 |
| JP | 2003-177680 | 6/2003 |
| JP | 2004-170815 | 6/2004 |
| JP | 2005-031630 | 2/2005 |
| JP | 2005-157349 | 6/2005 |
| JP | 2005-258407 | 9/2005 |
| JP | 2005-308897 | 11/2005 |
| JP | 2006-011368 | 1/2006 |
| JP | 2006-065282 | 3/2006 |
| JP | 2006-065286 | 3/2006 |
| JP | 2006-065328 | 3/2006 |
| JP | 2006-085141 | 3/2006 |
| JP | 2006-085169 | 3/2006 |
| JP | 2006-113548 | 4/2006 |
| JP | 2006-113586 | 4/2006 |
| JP | 2006-126778 | 5/2006 |
| JP | 2006-133731 | 5/2006 |
| JP | 2006-133745 | 5/2006 |
| KR | 2000-27755 | 5/2000 |
| KR | 2001-51967 | 6/2001 |
| KR | 2005-80318 | 8/2005 |
| KR | 10-2006-025285 | 3/2006 |
| KR | 2006-25283 | 3/2006 |
| KR | 10-2006-602357 | 7/2006 |
| WO | WO 2005/076254 A1 | 8/2005 |
| WO | WO 2005/122120 A3 | 12/2005 |

OTHER PUBLICATIONS

U.S. Appl. No. 11/651,017, filed Jan. 2007, Kim, Samsung SDI Co., Ltd.

Office Action issued by the Chinese Patent Office on Dec. 12, 2008.

Office Action issued May 31, 2007 by the Korean Intellectual Propery Office re: Korean Application No. 2006-50485 (3 pp).

Chinese Office Action dated Dec. 12, 2008, issued in corresponding Chinese Patent Application No. 200710108891.2

Korean Office Action dated May 31, 2007, issued in corresponding Korean Patent Application No. 2006-050484.

Chinese Office Action dated Dec. 12, 2008, issued in corresponding Chinese Patent Application No. 200710108891.2.

Japanese Office Action dated Oct. 22, 2009, issued in corresponding Japanese Patent Application No. 2006-198643.

Japanese Office Action dated Oct. 22, 2009, issued in corresponding Japanese Patent Application No. 2006-198644.

Japanese Office Action dated Mar. 2, 2010, issued in corresponding Japanese Patent Application No. 2006-198643.

Japanese Office Action dated Mar. 2, 2010, issued in corresponding Japanese Patent Application No. 2006-198644.

European Search Report dated Mar. 25, 2010, issued in corresponding European Patent Application No. 07251605.7.

U.S. Notice of Allowance dated May 14, 2010, issued in corresponding U.S. Appl. No. 11/651,017.

* cited by examiner

ORGANIC ELECTROLUMINESCENCE DISPLAY AND DRIVING METHOD THEREOF

CROSS-REFERENCE TO RELATED APPLICATION

This application claims the benefit of Korean Patent Application No. 2006-50485, filed on Jun. 5, 2006 in the Korean Intellectual Property Office, the disclosure of which is incorporated herein by reference.

BACKGROUND OF THE INVENTION

1. Field of the Invention

Aspects of the present invention relate to an organic electroluminescence display and a driving method thereof. More specifically, aspects of the present invention relate to an organic electroluminescence display capable of displaying a gray level using a frequency characteristic of an organic electroluminescence device, and a driving method thereof.

2. Description of the Related Art

Flat panel displays contain a plurality of pixels in a matrix arrangement on a substrate and have the pixels set as a display area. In the flat panel displays, scan lines and data lines are connected to pixels to display an image by selectively applying data signals to the pixels.

The flat panel displays are classified into different type displays according to a driving mode of a pixel, including a passive matrix-type light-emitting display and an active matrix-type light-emitting display. The active matrix-type light-emitting display which emits light from every pixel has been used mainly due to better resolution, contrast, and operating speed.

The active matrix-type light-emitting displays are used as displays for such devices as a personal computer, a portable phone, PDA, etc., or as monitors of various information appliances even though various other types of flat panel displays are known in the art. Other types of flat panel displays include liquid crystal displays (LCDs) using a liquid crystal panel, organic electroluminescence displays using an organic electroluminescence device, and plasma display panels (PDPs) using a plasma panel, etc.

Recently, various light-emitting displays have been developed having a smaller weight and volume than a cathode ray tube, and attention has been particularly paid to organic electroluminescence displays which are excellent in luminous efficiency, luminance and viewing angles, and have rapid response times.

FIG. 1 is a view of a circuit showing a pixel used in one related art organic electroluminescence display. Referring to FIG. 1, the pixel is formed on a region where a data line (Dm) and a scan line (Sn) are crossed, and includes a first transistor (T11), a second transistor (T21), a capacitor (Cst), a compensation circuit 11, and an organic electroluminescence device (OLED). During operation, the pixel is selected by receiving a scan signal through the scan line (Sn), and a data signal is transmitted to the selected pixel through the data line (Dm) so that a luminance corresponding to the data signal is displayed. Also, each pixel is operated by receiving power from a first power supply (ELVdd) and a second power supply (ELVss).

The first transistor (T11) allows a current to flow from a source to a drain according to a signal applied to a gate electrode, and has a gate connected to the compensation circuit 11, a source connected to the first power supply (ELVdd), and a drain connected to the organic electroluminescence device (OLED).

The second transistor (T21) transmits a data signal to the compensation circuit 11 according to the scan signal, and has a gate connected to the scan line (Sn), a source connected to the data line (Dm), and a drain connected to the compensation circuit 11.

The capacitor (Cst) applies a voltage to the compensation circuit 11 that corresponds to the data signal. The capacitor (Cst) maintains a voltage of the data signal during a predetermined period. Therefore, the first transistor (T11) allows a current that corresponds to the voltage of the data signal to flow during a predetermined period. As a result, even if the data signal is interrupted by the second transistor (T21), since the first electrode is connected to the first power supply (ELVdd) and the second electrode is connected to the compensation circuit 11, the second electrode maintains a voltage that corresponds to the data signal. Accordingly, the voltage that corresponds to the data signal is maintained on the gate of the first transistor (T11) during the predetermined period.

The compensation circuit 11 compensates for a threshold voltage of the first transistor (T11) by receiving a compensation control signal. Accordingly, the compensation circuit 11 prevents unevenness of a luminance due to unevenness of a threshold voltage. The compensation control signal may be transmitted by an additional signal line or may be transmitted by the scan line.

The organic electroluminescence device (OLED) has an organic film formed between an anode electrode and a cathode electrode so that the organic film is allowed to emit light. Light is emitted from the organic film if a current flows from the anode electrode to the cathode electrode. In the OLED shown in FIG. 1, the anode electrode is connected to the drain of the first transistor (T11) and the cathode electrode is connected to the second power supply (ELVss). The organic film includes an emitting layer (EML), an electron transport layer (ETL) and a hole transport layer (HTL). Also, the organic electroluminescence device may further include an electron injection layer (EIL) and a hole injection layer (HIL).

FIG. 2 is a view of a circuit showing another pixel used in a related art organic electroluminescence display. Referring to FIG. 2, the pixel includes a first transistor (T12), a second transistor (T22), a third transistor (T32), a fourth transistor (T42), a capacitor (Cst), and an organic electroluminescence device (OLED). The OLED shown is referred to as a current-driving pixel circuit for controlling a luminance using a current.

During operation of the current-driving pixel circuit, when the second transistor (T22) and the third transistor (T32) are in an ON state based on the scan signal, a current is generated in the first transistor (T12) that corresponds to a current flowing to the data line. At this time, a voltage corresponding to a capacity of the current is stored in the capacitor (Cst). Thereafter, when the second transistor (T22) and the third transistor (T32) are in an OFF state, the first transistor (T12) allows a current to flow to the organic electroluminescence device (OLED) due to the voltage stored in the capacitor (Cst). The current-driving pixel circuit as configured above does not have problems arising from an unevenness of a threshold voltage, etc., since the circuit uses the flowing current.

As described above, the pixel as shown in FIG. 1 should include a circuit for compensating for an uneven threshold voltage, while the pixel as shown in FIG. 2 is not suitable for a large screen of the organic electroluminescence display since time needed for charging by a current is increased due to a parasitic capacitor, etc., and since the driving circuit is more complicated.

SUMMARY OF THE INVENTION

Accordingly, aspects of the present invention includes an organic electroluminescence display has simple configurations of a pixel circuit and a driving circuit by using a frequency characteristic of an organic electroluminescence device to display a gray level, and a driving method thereof.

According to an aspect of the present invention an organic electroluminescence display includes a plurality of scan lines to transmit a scan signal; a plurality of data lines to transmit a digital data signal; a plurality of emission control lines to transmit an emission control signal; and a plurality of pixels defined by a plurality of power supply lines to supply power, wherein the scan signal is transmitted according to a plurality of subframes, and the emission control signal have different frequencies according to each of the plurality of the subframes.

According to an aspect of the present an organic electroluminescence display includes a pixel unit including a plurality of pixels defined by a plurality of scan lines to which a scan signal is transmitted, a plurality of data lines to which an n-bit digital data signal is transmitted, a plurality of emission control lines to which an emission control signal is transmitted, and a plurality of power supply lines to supply power; a data driving unit to transmit each bit of the n-bit digital data signal to the data lines; a scan driving unit to transmit the scan signal to the scan lines according to a plurality of the subframes; and an emission control driving unit to transmit the emission control signal to the emission control lines, wherein the emission control signal has different frequencies corresponding to each of the plurality of the subframes.

According to an aspect of the present invention a method of driving an organic electroluminescence display includes generating a current to correspond to each bit of an n-bit digital data signal; carrying out a switching operation on the generated current to turn on or off the current; and controlling an organic electroluminescence device to emit light of different grayscales according to a frequency of the turning on/off of the current.

According to an aspect of the present invention, a pixel of an electroluminescence device includes: a scan line to receive a scan signal; a data line to receive a data signal; an emission control line to receive an emission control signal carrying a frequency component corresponding to a frequency characteristic of the electroluminescence device; and a transistor to control flow of current according to the frequency component of the emission control signal to display a brightness of each of a plurality of subframes.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the aspects, taken in conjunction with the accompanying drawings of which.

DETAILED DESCRIPTION OF THE EMBODIMENTS

Figure 1:
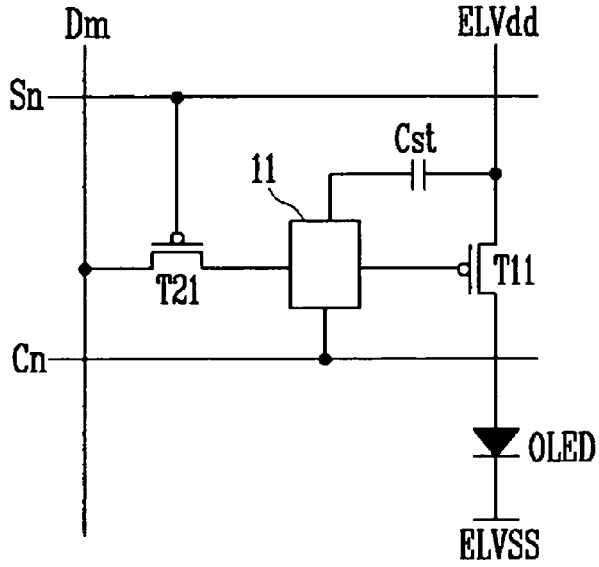
FIG. 1 (RELATED ART)
FIG. 1 is a view of a circuit showing a pixel used in a related art organic electroluminescence display.
Figure 2:
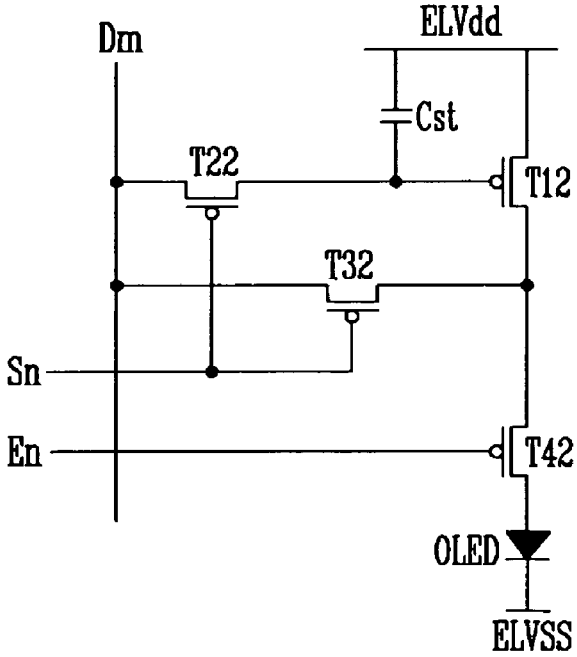
FIG. 2 (RELATED ART)
FIG. 2 is a view of a circuit showing another pixel used in a related art organic electroluminescence display.

Reference will now be made in detail to the aspects of the present invention, examples of which are illustrated in the accompanying drawings, wherein like reference numerals refer to the like elements throughout. The aspects are described below in order to explain the present invention by referring to the figures.

Figure 3:
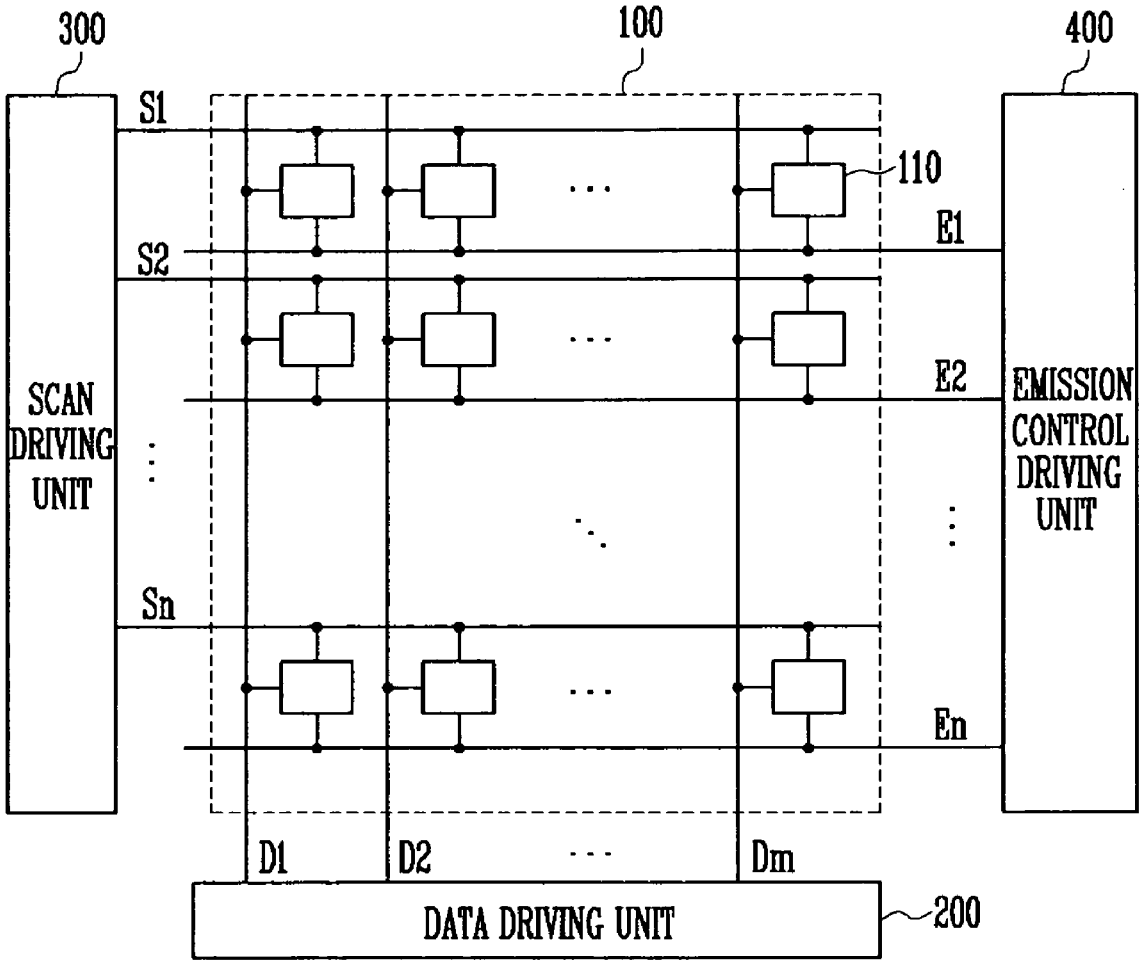
FIG. 3 is a schematic view showing a configuration of an organic electroluminescence display according to an aspect of the present invention.

FIG. 3 is a schematic view showing a configuration of an organic electroluminescence display according to an aspect of the present invention. Referring to FIG. 3, the organic electroluminescence display includes a pixel unit 100, a data driving unit 200, a scan driving unit 300, and an emission control driving unit 400.

As shown, the pixel unit 100 includes a plurality of data lines (D1, D2 . . . Dm−1, Dm) and a plurality of scan lines (S1, S2 . . . Sn−1, Sn), and a plurality of pixels formed in a region defined by the plurality of the data lines (D1, D2 . . . Dm−1, Dm) and the plurality of the scan lines (S1, S2 . . . Sn−1, Sn). As shown, the pixel 110 includes a pixel circuit and an organic electroluminescence device (not shown), and generates a pixel current in the pixel circuit to flow to the organic electroluminescence device. The pixel current flows in the pixels 110 according to data signals transmitted through the plurality of the data lines (D1, D2 . . . Dm−1, Dm) and scan signals transmitted through the plurality of the scan lines (S1, S2 . . . Sn−1, Sn). During operation, each pixel 110 distinguishes a plurality of subframes of the one frame. Also, a gray level displayed in the pixel 110 is determined by a sum of luminances emitted in (during) each period of the subframes.

The data driving unit 200 is connected with the plurality of the data line (D1, D2 . . . Dm−1, Dm), and generates n-bit data signals to be sequently transmitted to the plurality of the data lines (D1, D2 . . . Dm−1, Dm).

The scan driving unit 300 is connected to the plurality of the scan lines (S1, S2 . . . Sn−1, Sn), and generates scan signals to be transmitted to the plurality of the scan lines (S1, S2 . . . Sn−1, Sn). Accordingly, the scan signals are transmitted according to each unit of the subframes, and then each row of the pixel unit 100 is sequently selected so that the digital data signals are transmitted into the selected rows of the plurality of the scan lines (S1, S2 . . . Sn−1, Sn).

The emission control driving unit 400 transmits emission control signals to emission control lines (E1, E2, . . . En). The emission control signals have different frequencies in every subframe. Therefore, a brightness of the pixel 110 is determined by the emission control signals when the current generated by the data signal is transmitted to the organic electroluminescence device (OLED) according to the frequencies of the emission control signals.

In FIG. 3, the scan driving unit 300 and the emission control driving unit 400 are shown as separate units, but such is not required. In other aspects, the scan driving unit 300 and the emission control driving unit 400 may be combined.

Figure 4:
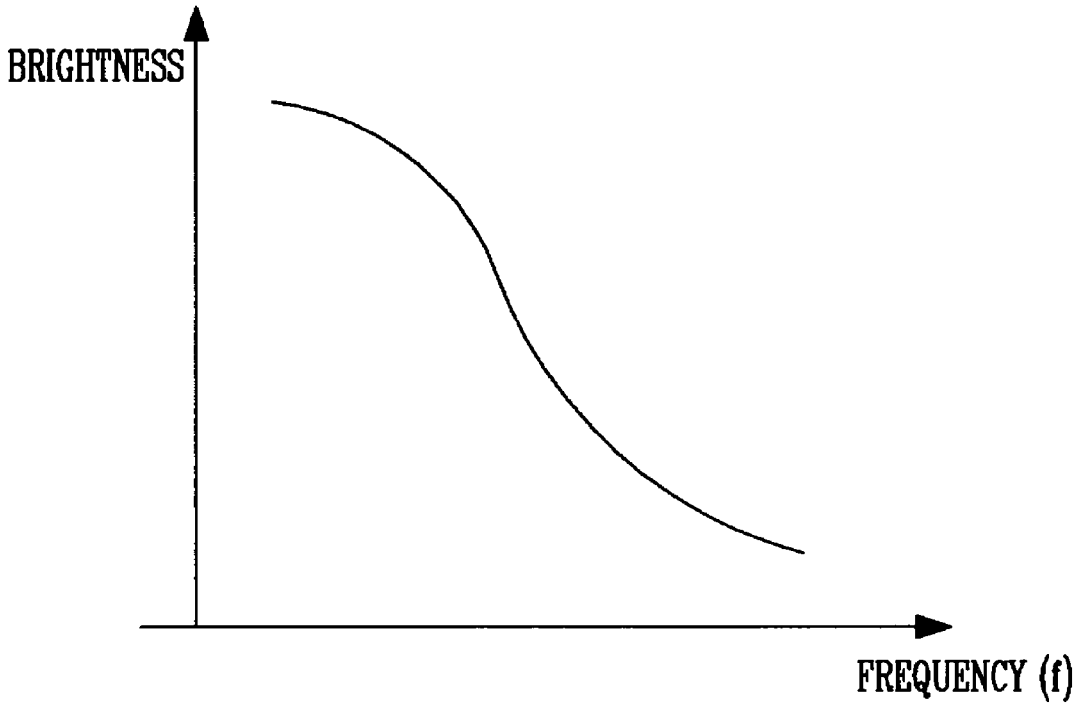
FIG. 4 is a diagram showing a change of luminances corresponding to frequencies of an organic electroluminescence device of the organic electroluminescence display as shown in FIG. 3.

FIG. 4 is a diagram showing a change of luminances (brightness) relative to frequencies of an organic electroluminescence device used in the organic electroluminescence display as shown in FIG. 3. As shown, the luminance of the organic electroluminescence device diminishes when a high frequency signal is transmitted to the organic electroluminescence device, but the luminance of the organic electroluminescence device increases when a low frequency signal is inputted and passed through the organic electroluminescence device. As a result, the organic electroluminescence device (OLED) exhibits a high luminance if the inputted signal frequency is low, while the organic electroluminescence device (OLED) exhibits a low luminance if the inputted signal frequency is high.

Figure 5:
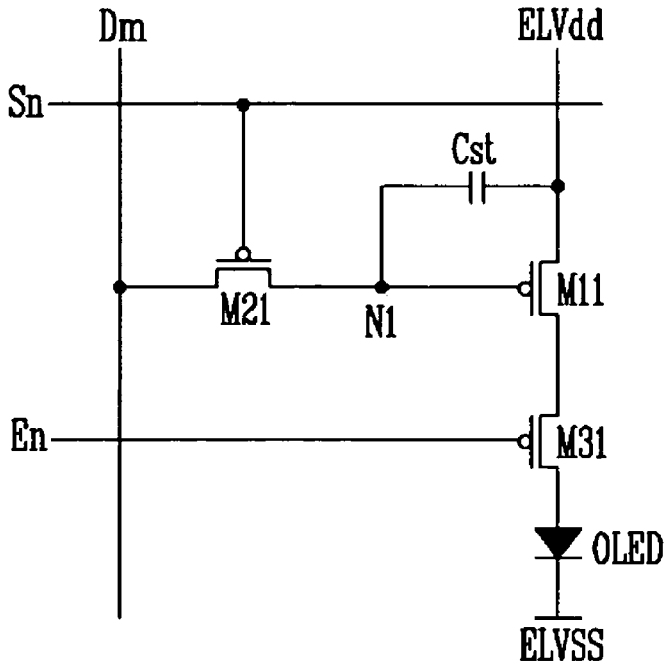
FIG. 5 is a view of a circuit showing one aspect of a pixel used in the organic electroluminescence display as shown in FIG. 3.

FIG. 5 is a view of a circuit showing one aspect of the pixel used in the organic electroluminescence display as shown in FIG. 3. As shown, the pixel includes a first transistor (M11), a second transistor (M21), a third transistor (M31), a capacitor (Cst), and an organic electroluminescence device (OLED). In various aspects, the first to third transistors (M11 to M31) are accomplished using a p-type metal-oxide semiconductor (PMOS) transistor. It is understood that other types of transistors are usable.

The first transistor (M11) has a gate connected to the first node (N1), a source connected to the first power supply (ELVdd), and a drain connected to a source of the third transistor (M31). Accordingly, a current flows from the source to the drain of the first transistor (M31) according to the voltage transmitted to the first node (N1).

The second transistor (M21) has a gate connected to the scan line (Sn), a source connected to the data line (Dm), and a drain connected to the first node (N1). Accordingly, the data signal flowing through the data line (Dm) is transmitted to the first node (N1) according to the scan signal transmitted through the scan line (Sn).

The third transistor (M31) has a gate connected to the emission control line (En), a source connected to the drain of the first transistor (M11), and a drain connected to the organic electroluminescence device (OLED). Accordingly, a current flowing from the source to the drain of the third transistor (M31) is transmitted to the organic electroluminescence device (OLED) according to the emission control signal transmitted through the emission control line (En). Also, the emission control signal transmitted through the emission control line (En) has a frequency. More specifically, the emission control signal repeats signals "0" and "1" to transmit the signals "0" and "1" to the gate of the third transistor (M31) if the digital data signal that is transmitted to the capacitor (Cst) is set to "0" (i.e., when the second transistor is in an OFF state). As a result, the third transistor (M31) carries out an ON/OFF operation according to the frequency of the respective emission control signal, and controls a frequency of the current transmitted to (or controls how frequently the current is transmitted to) the organic electroluminescence device (OLED). On the other hand, if the digital data signal that is transmitted to the capacitor (Cst) is set to "1", then the first transistor (M11) is in an OFF state and interrupts the current that is to flow to the organic electroluminescence device (OLED).

The capacitor (Cst) has a first electrode connected to the first power supply (ELVdd) and a second electrode connected to the first node (N1) to maintain a voltage of the first node (N1) during a predetermined period. Accordingly, the voltage of the data signal is maintained in the first node (N1) by the capacitor (Cst) even when the second transistor (M21) is in an OFF state.

The organic electroluminescence device (OLED) receives the current whose frequency is controlled by the third transistor (M31) so that light is emitted and a gray level corresponding to the frequency is displayed.

Figure 6:
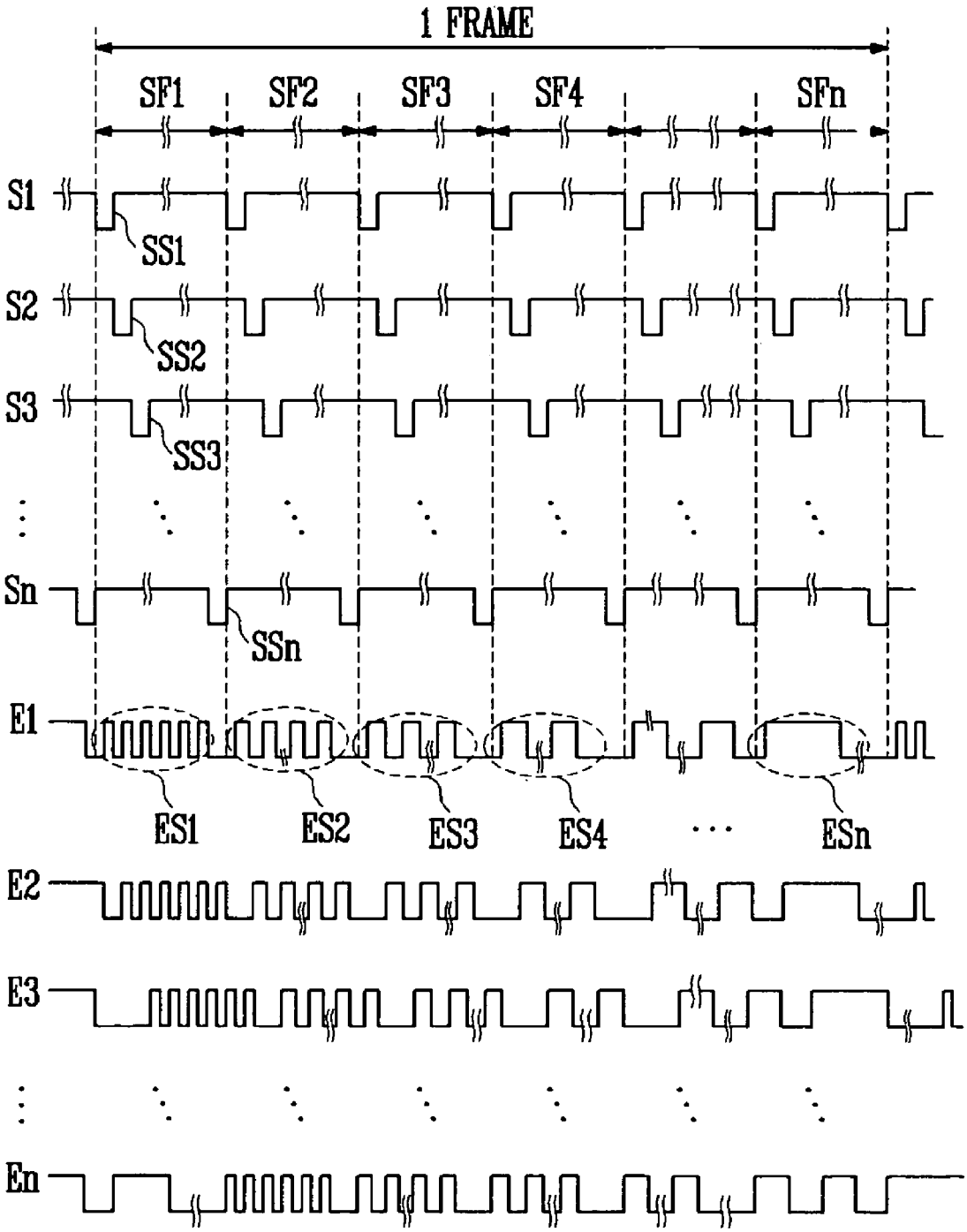
FIG. 6 is a waveform view showing a method of driving the pixel as shown in FIG. 4.

FIG. 6 is a waveform view showing a method of driving the pixel as shown in FIG. 4. As shown, one frame is divided into n number of subframes (SF1, SF2, SF3 . . . SFn) to correspond to an n-bit digital signal. The n number of the subframes (SF1, SF2, SF3 . . . SFn) are operated to display a gray level in the organic electroluminescence device. During operation, the n number of the subframes (SF1, SF2, SF3 . . . SFn) have the gray levels corresponding to the different brightnesses, based on the emission control signals (ES1, ES2 . . . ESn−1, ESn). The ratios of the gray levels corresponds to the brightnesses of the first to nth subframes (SF1, SF2, SF3 . . . SFn) are $2^0:2^1:2^2:2^3:2^4 \ldots 2^n$.

Firstly, when a low state (a low pulse) of the scan signals (SS1, SS2 . . . SSn−1, SSn) is sequently supplied into each of the scan lines (S1, S2 . . . Sn−1, Sn) in the first subframe (SF1) of the one frame, the second transistors (M21) connected to each of the scan lines (S1, S2 . . . Sn−1, Sn) are sequently turned on. At the same time, the emission control signal (ES1) is transmitted to a gate of the third transistor (M31) through the emission control line (En) so as to be synchronized with the low state of the scan signals. Also, the first-bit digital data signal (not shown) out of the n bits supplied as the data signals transmitted through the data line (Dm) is transmitted to the gate of each first transistor (M11). Accordingly, each capacitor (Cst) stores a voltage difference of a voltage of the first-bit digital signal and a voltage of the first power supply (ELVdd).

Subsequently, if a high state of the scan signals is supplied to the scan lines (S1, S2 . . . Sn−1, Sn), then the second transistor (M21) connected to the scan lines (S1, S2 . . . Sn−1, Sn) will be turned OFF. However, since the first-bit digital data signal is stored in each capacitor (Cst), the first-bit digital data signal is continuously transmitted to the gate electrode of the first transistor (M11), and a current will continuously flow from a source to a drain of the first transistor (M11). At this time, the third transistor (M31) carries out a switching operation using the emission control signal (ES1), and the current, which flows from the source to the drain of the first transistor (M11), will be transmitted to the OLED according to a frequency of the emission control signal (ES1).

As discussed above, the organic electroluminescence device (OLED) has a characteristic as shown in FIG. 4, wherein the brightness diminishes if the current is supplied with a high frequency, while the brightness increases if the current is supplied with a low frequency and is passed through the organic electroluminescence device (OLED). Accordingly, the organic electroluminescence device (OLED) emits light according to the frequency of the emission control signal (ES21) corresponding to the first-bit digital data signal during a first subframe (SF1) period. That is to say, the organic electroluminescence device (OLED) is not allowed to emit light if the digital data signal of the first bit is set to "1" (i.e., if turned OFF), and is allowed to emit light with a brightness corresponding to "$2^0$" gray level if the digital data signal of the first bit is set to "0" (i.e., turned ON).

Similarly, if a low state of the scan signals is supplied to each of the scan lines (S1, S2 . . . Sn−1, Sn) in the second subframe (SF2) of the one frame, then the second transistor (M21) connected to each of the scan lines (S1, S2 . . . Sn−1, Sn) are sequently turned on. At the same time, the emission control signal (ES2) is transmitted to a gate of the third transistor (M31) through the emission control line (En) so as to be synchronized with the low state of the scan signals. Also, the second-bit digital data signal (not shown) out of the n bits supplied as the data signals transmitted through the data line (Dm) is transmitted to the gate of each first transistor (M11). Accordingly, each capacitor (Cst) stores a voltage difference of a voltage of the second-bit digital signal and a voltage of the first power supply (ELVdd).

Subsequently, if a high state of the scan signals is supplied to the scan lines (S1, S2 . . . Sn−1, Sn), then the second transistor (M21) will be turned OFF. However, since the second-bit digital data signal is stored in each capacitor (Cst), the second-bit digital data signal is continuously transmitted to the gate electrode of the first transistor (M11), and a current will continuously flow from a source to a drain of the first transistor (M11). At this time, the third transistor (M31) carries out a switching operation using the emission control signal (ES2), and the current, which flows from the source to the drain of the first transistor (M11), will be transmitted to the OLED according to a frequency of the emission control signal (ES2).

As discussed above, the organic electroluminescence device (OLED) has a characteristic as shown in FIG. 4, wherein the brightness diminishes if the current is supplied with a high frequency, while the brightness increases if the current is supplied with a low frequency, and is passed through the organic electroluminescence device (OLED). Accordingly, the organic electroluminescence device (OLED) emits light according to the frequency of the emission control signal (ES2) corresponding to the second-bit digital data signal during a second subframe period (SF2). That is, the organic electroluminescence device (OLED) is not allowed to emit the light if the digital data signal of the first bit is set to "1," and is allowed to emit the light with a brightness corresponding to "$2^1$" grey level if it is set to "0."

In the same manner, a current corresponding to the third-bit data signal will be transmitted to the OLED according to a frequency of the emission control signal (ES3), and therefore, the organic electroluminescence device (OLED) will emit light with a brightness corresponding to any one of "0" or "$2^2$" gray levels during a third subframe period in the third subframe (SF3) of the one frame, as described above.

Also, the same operation is carried out in each of the fourth subframe (SF4) to the $n^{th}$ subframe (SFn) of the one frame, and the current generated by the first transistor (M11) will be transmitted to the OLED according to a frequency of the emission control signals (ES4 . . . ESn), and therefore, the organic electroluminescence device (OLED) will emit light with a brightness corresponding to "0" or "$2^3$" to "$2^n$" gray levels.

Accordingly, the organic electroluminescence display according to an aspect of the present invention and the driving method thereof display a desired gray level achieved by the sum of the brightnesses of each of the subframes by utilizing a frequency characteristic of the organic electroluminescence device as shown in FIG. 4.

Figure 7:
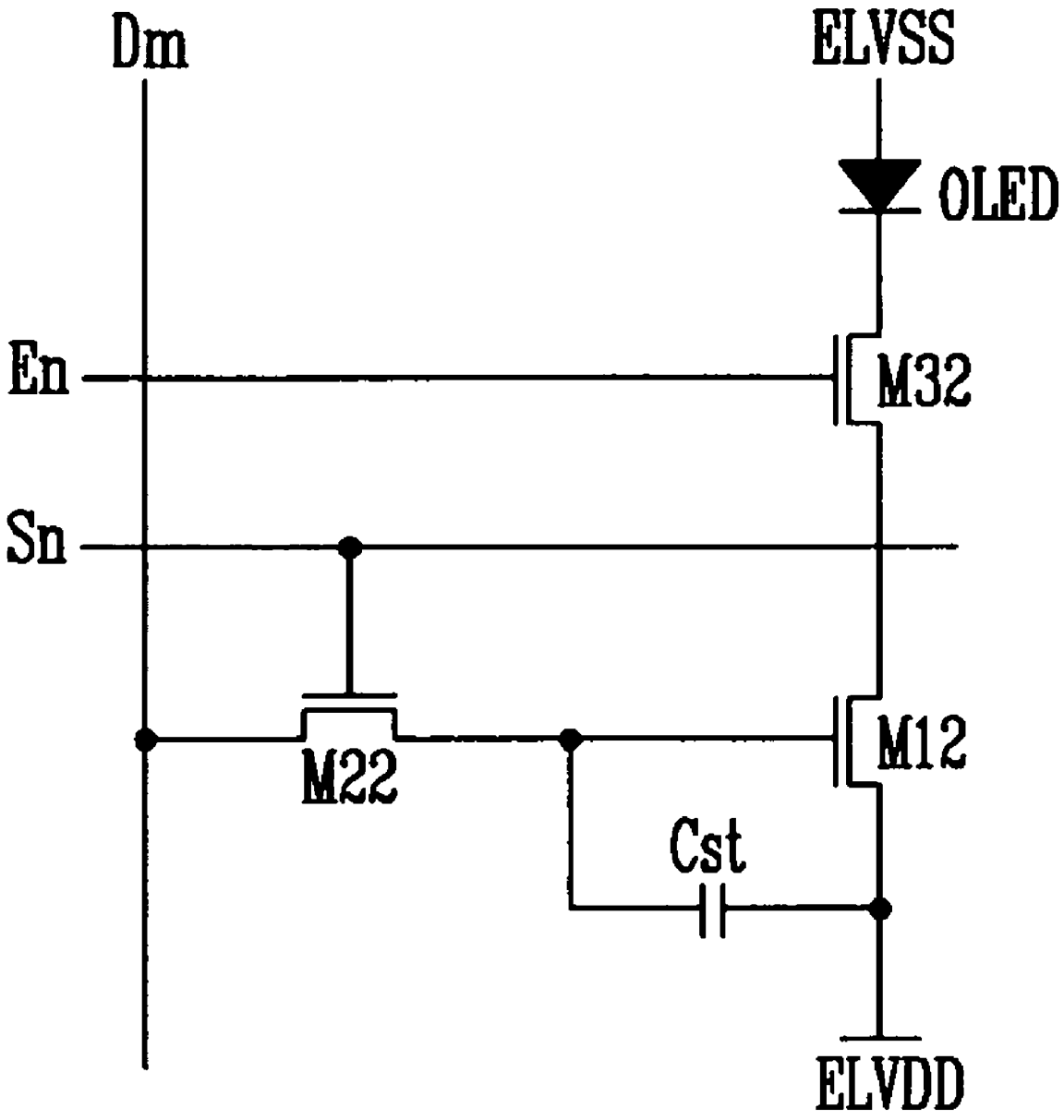
FIG. 7 is a view of a circuit showing another of the pixel used in the organic electroluminescence display as shown in FIG. 3.
Figure 8:
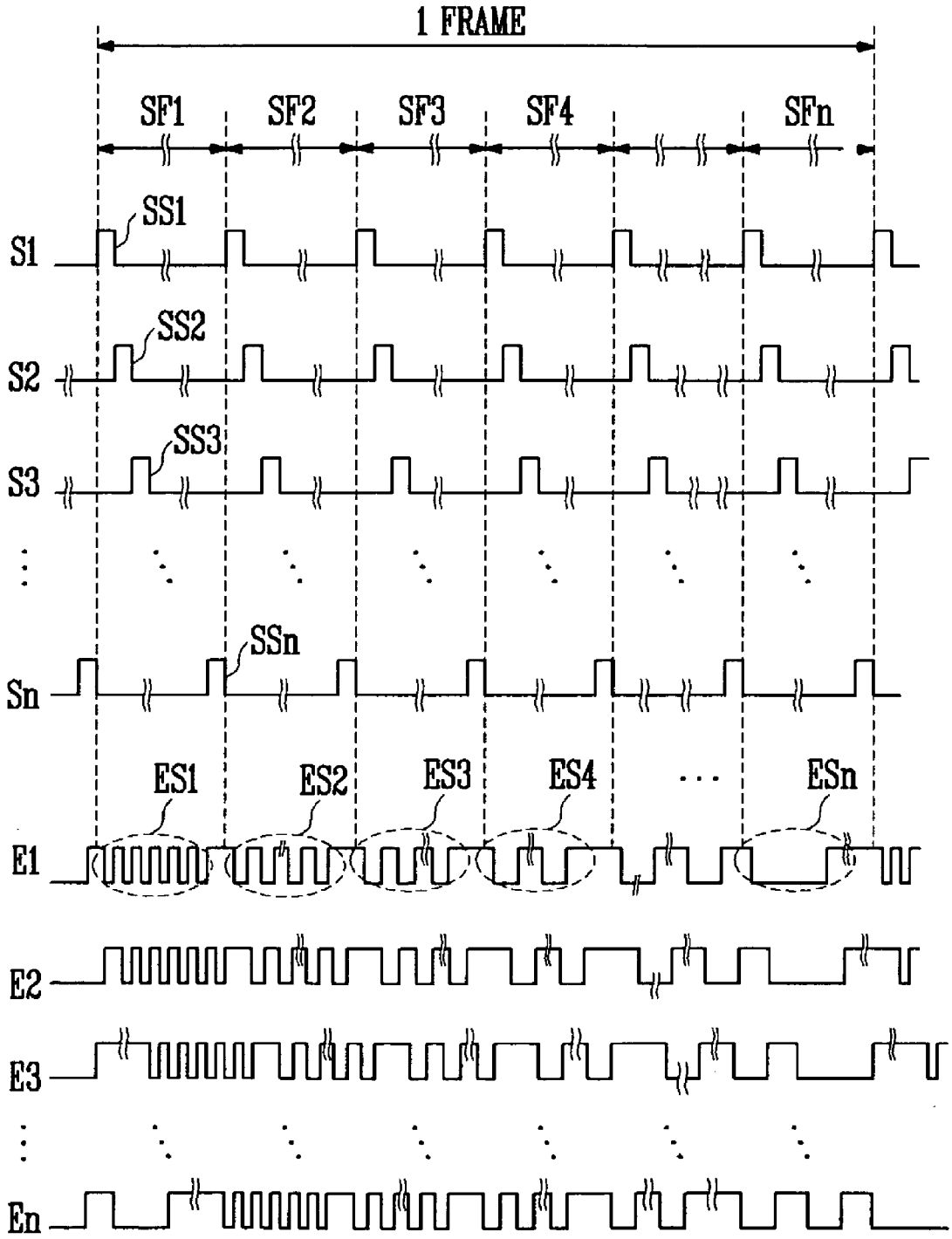
FIG. 8 is a waveform view showing another method of driving the pixel as shown in FIG. 7.

FIG. 7 is a view of a circuit showing another aspect of the pixel used in the organic electroluminescence display as shown in FIG. 3. FIG. 8 is a waveform view showing a method of driving the pixel as shown in FIG. 7. In the aspects as shown in FIG. 7 and FIG. 8, the pixel includes first to third transistors (M12 to M32) and a capacitor (Cst). The first to third transistors (M12 to M32) may be implemented using an n-type metal-oxide semiconductor (NMOS) transistor, and their operations are carried out in a similar manner as in the aspect of the present invention as shown in FIG. 4. It is understood, however, that other types of transistors may be used.

That is, the pixel according to the aspect of the present invention shown in FIG. 7, and the organic electroluminescence display includes what are referred to as N-type transistors. As shown, if the scan signal and the emission control signal are in a high state, then the transistors are in an ON state, and if the signals are in a low state, then the transistors are in an OFF state. The operation of the pixel using the N-type transistors can be easily carried out by those skilled in the art using the description of the aspects of the present invention according to FIGS. 4 and 5, showing the transistors implemented by P-type transistors.

Meanwhile, although the aspects of the present invention disclose that each pixel has first to third transistors and one capacitor, as described above, the pixel according to aspects of the present invention is not limited thereto, and may have at least three transistors and one capacitor.

Also, although the descriptions of the above aspects of the present invention disclose that each subframe has the same period of emission, the subframe may have a different period of emission for the purpose of the gray level presentation and the image improvement, and the organic electroluminescence display having the pixel that controls a current to display an image may be also applied in the same manner as described above.

The organic electroluminescence display according to aspects of the present invention and the driving method thereof may be useful to simplify the pixel circuit and the driving circuit by using a frequency characteristic of the organic electroluminescence device to display a gray level.

Although a few aspects of the present invention have been shown and described, it would be appreciated by those skilled in the art that changes might be made in the aspects without departing from the principles and spirit of the invention, the scope of which is defined in the claims and their equivalents.

What is claimed is:

1. An organic electroluminescence display comprising:

a plurality of scan lines to transmit a scan signal;

a plurality of data lines to transmit a digital data signal;

a plurality of emission control lines to transmit an emission control signal; and a plurality of pixels defined by a plurality of power supply lines to supply power, wherein the scan signal is transmitted according to a plurality of subframes, and the emission control signal has different frequencies according to each of the plurality of the subframes.

2. The organic electroluminescence display according to claim 1, wherein each of the plurality of pixels displays a desired grey level by summing the different brightnesses of each of the subframes.

3. The organic electroluminescence display according to claim 1, wherein the frequencies of the emission control signal become smaller sequently with the most significant bit of the digital data signal.

4. The organic electroluminescence display according to claim 1, wherein the digital data signal has N bits, and the plurality of the subframes has N subframes.

5. The organic electroluminescence display according to claim 1, wherein the pixel operates in accordance with one of the bits of the digital data signal of each of the N subframes.

6. An organic electroluminescence display comprising:

a pixel unit including a plurality of pixels defined by a plurality of scan lines to which a scan signal is transmitted, a plurality of data lines to which an n-bit digital data signal is transmitted, a plurality of emission control lines to which an emission control signal is transmitted, and a plurality of power supply lines to supply power;

a data driving unit to transmit each bit of the n-bit digital data signal to the data lines;

a scan driving unit to transmit the scan signal to the scan lines according to a plurality of the subframes; and an emission control driving unit to transmit the emission control signal to the emission control lines, wherein the emission control signal has different frequencies corresponding to each of the plurality of the subframes.

7. The organic electroluminescence display according to claim 6, wherein each of the plurality of pixels displays a desired grey level by summing the different brightnesses of each of the subframes.

8. The organic electroluminescence display according to claim 6, wherein the frequencies of the emission control signal become smaller sequentially with the most significant bit of the n-bit digital data signal.

9. The organic electroluminescence display according to claim 6, wherein a plurality of the subframes includes N number of subframes, and one subframe corresponds to one of the bits of the n-bit digital signal.

10. A method of driving an organic electroluminescence display having a plurality of pixels each having a scan line, a data line and an organic electroluminescence device disposed at the intersection of the scan line and the data line, the method comprising:

generating a current, flowing to the organic electroluminescence device, to correspond to each bit of an n-bit digital data signal transmitted on the data line;

carrying out a switching operation on the generated current to turn on or off the current; and controlling the organic electroluminescence device with an emission control signal having different frequencies according to each of a plurality of subframes to emit light of different grayscales according to a frequency of the turning on/off of the current flowing to the organic electroluminescence device.

11. The method of driving an organic electroluminescence display according to claim 10, wherein the switching operation is carried out using different frequencies in each of the n subframes corresponding to the n bits.

12. The method of driving an organic electroluminescence display according to claim 11, wherein the frequencies of the switching operation becomes smaller sequently with the most significant bit of the n-bit digital data signal.

13. The method of driving an organic electroluminescence display according to claim 11, wherein the organic electroluminescence display has a different brightness in each of the subframes.

* * * * *